US005695611A

United States Patent [19]

Bubik et al.

[11] Patent Number: 5,695,611

[45] Date of Patent: Dec. 9, 1997

[54] PROCESS FOR MODIFYING A BREAST BOX FOR A PAPER OR CARTONMAKING MACHINE

[75] Inventors: Alfred Bubik, Ravensburg, Germany; Peter Drtina, Winterthur, Switzerland; Harald Hess, Grunkraut, Germany; Michael Kochendorfer, Berg, Germany; Klaus Lehleiter, Mengen, Germany; Thomas Merath, Weingarten, Germany; Peter Mirsberger, Baienfurt, Germany; Andreas Steidele, Ravensburg, Germany; Martin Tietz, Sao Paulo, Brazil; Robert Trondle, Ravensburg, Germany

[73] Assignee: Voith Sulzer Papiermaschinen GmbH, Heidenheim, Germany

[21] Appl. No.: 544,189

[22] Filed: Oct. 17, 1995

[30] Foreign Application Priority Data

Oct. 18, 1994 [DE] Germany ..... 44 37 180.2

[51] Int. Cl.[6] ..... D21F 1/08

[52] U.S. Cl. ..... 162/199; 162/272; 162/258; 162/336; 162/343

[58] Field of Search ..... 162/199, 343, 162/258, 336, 272; 29/401.1

[56] References Cited

U.S. PATENT DOCUMENTS

| | | | |
|---|---|---|---|
| 4,539,075 | 9/1985 | Majaniemi | 162/343 |
| 4,980,027 | 12/1990 | Keller | 162/343 |
| 5,490,905 | 2/1996 | Huovila et al. | 162/343 |
| 5,510,005 | 4/1996 | Gingerich | 162/343 |
| 5,545,293 | 8/1996 | Huovila et al. | 162/336 |

FOREIGN PATENT DOCUMENTS 4019593 1/1992 Germany .

*Primary Examiner*—Karen M. Hastings
*Attorney, Agent, or Firm*—Greenblum & Bernstein, P.L.C.

[57] ABSTRACT

Process for modifying an existing breast box for a paper or cartonmaking machine as well as an intermediate portion for carrying out the process. During the fabrication of a breast box for a paper or cartonmaking machine an intermediate portion is interposed between a supply apparatus and a downstream guiding device, with the material suspension flowing through this intermediate portion wherein, via supply lines, located on the intermediate portion, a liquid is added which differs from that of the suspension stream. Particularly, in this manner, already existing breast boxes can be converted, to water dilution technology, with this invention setting forth special embodiments of differing intermediate portions that can be utilized therefor.

3 Claims, 3 Drawing Sheets

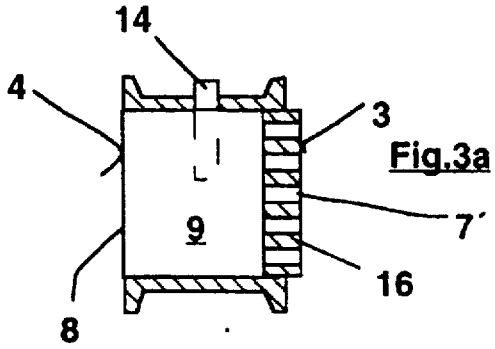
Fig.3a
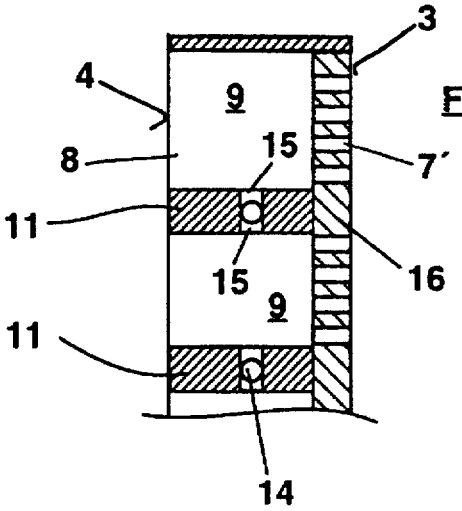
Fig.3b
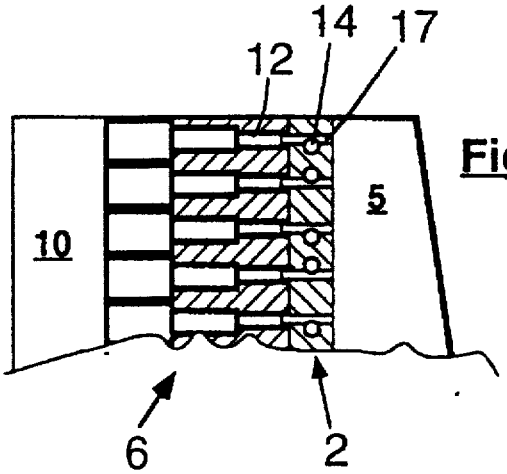
Fig.7
Fig.8a
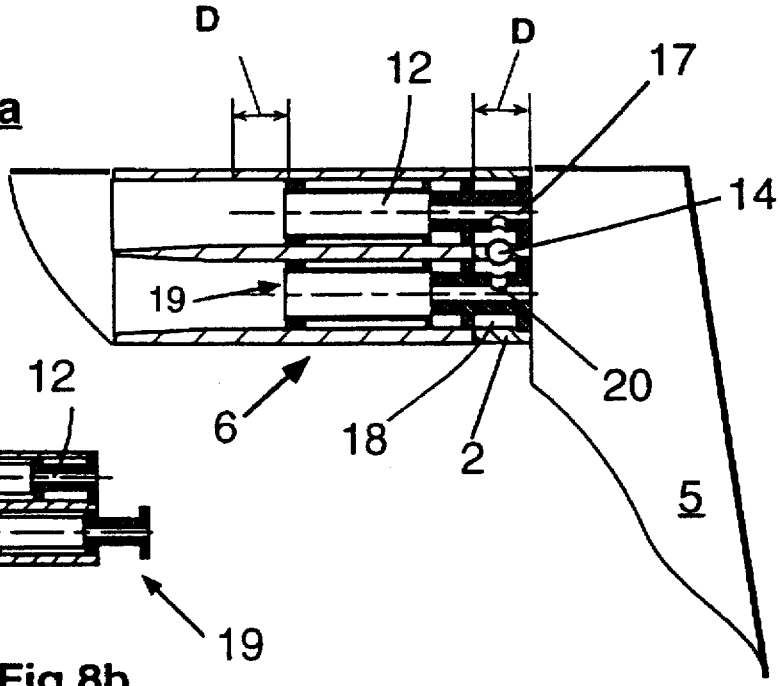
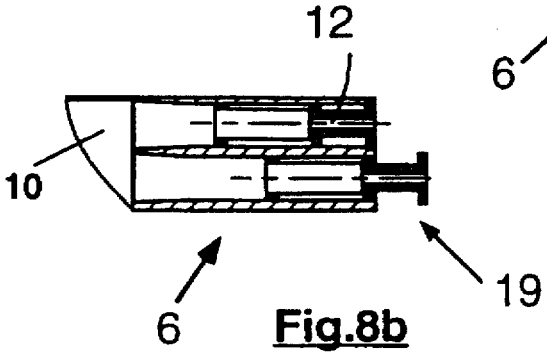
Fig.8b

PROCESS FOR MODIFYING A BREAST BOX FOR A PAPER OR CARTONMAKING MACHINE

CROSS REFERENCE TO RELATED APPLICATIONS

This application claims the priority of German Application No. DE P 44 37 180.2, filed Oct. 18, 1994, the disclosure of which is incorporated herein by reference in its entirety.

BACKGROUND OF THE INVENTION

1. Field of the Invention

This invention pertains to a process for the production of a breast box for a papermaking or cartonmaking machine, including the following elements: a supply apparatus for supplying a material suspension across the width of the machine; a guiding device, for the material suspension, located dowstream of the supply apparatus; a nozzle chamber, having a wide aperture, from which aperture the material suspension exits as a stream from the breast box, located dowstream of the guiding device; and means for supplying a livid, with the material density of the livid differing from the material density of the suspension stream.

2. Discussion of the Background of the Invention and Material Information

As is known, new developments in the area of breast boxes of papermaking machines have led, in addition to the actual material suspension stream that is required for papermaking, to a further controlled addition of fluid, for example water or suspension of a differing material density. This addition occurs over several locations dispersed over the width of the breast box. In this manner, the amount and/or properties of the fluid are adjustable. Via this measure, for example, the basic weight cross sectional profile can be controlled or the occurrence of cross stream or currents in the breast box can be prevented.

German Patent Publication DE 40 19 593 C2 discloses such a breast box. The addition of the fluid occurs via inlet openings in the wall of the mixing chamber or directly in the turbulence producers. In order to locally limit the effect of the added fluid, in some instances, partition walls are added in the mixing chamber.

The above-described local addition of dilution water into the breast boxes has proved itself to be particularly advantageous in many application cases. This begets the desire, in such cases, to modify already existing and otherwise good operating breast boxes with this new technique. This entails, up to now, the removal of large and heavy parts of the breast box and the acceptance of considerable risk for transporting same to the supplier thereof, since as a general rule the necessary reworking thereof could only be accomplished there. Due to the absence of these parts, the breast box and thus the entire papermaking machine is not useable during this time period. In addition, the reworking of the disassembled breast box is also very expensive.

It is the task or object of this invention to make those breast boxes operable with this technique which have no or no satisfactory possibility for a local addition of fluid, with the aid of a conversion part that is prefabricated and which can be installed in the breast boxes.

SUMMARY OF THE INVENTION

This task or object is achieved via the measures set forth in the appended claims.

A first embodiment of this invention pertains to a process for the production of a breast box for a papermaking or cartonmaking machine, that includes the following elements: a supply apparatus for supplying a material suspension across the width of the machine; a guiding device, for the material suspension, located downstream of the supply apparatus; a nozzle chamber, having a wide aperture, from which aperture the material suspension exits as a stream from the breast box, located downstream of the guiding device; and means for supplying a liquid, with the material density of the liquid differing from the material density of the suspension stream; wherein the process comprises: inserting an intermediate piece, having an upstream attachment surface and a downstream attachment surface, between the supply apparatus and the guiding device, with the material suspension flowing from the supply apparatus to the guiding device via the intermediate piece; and supplying the liquid, for the material suspension flowing through the intermediate piece during the operation of the breast box, via at least one supply line contained within the intermediate piece, with the material density of the liquid differing from the material density of the suspension stream.

In a variation of the previous embodiment, the guiding device of the breast box includes a plurality of channels, with the channels being formed with the aid of channel inserts, the process further comprising: extending the channel inserts from the guiding device, in the upstream direction, for an extent about equal to the thickness (D) of the intermediate piece and wherein each channel insert includes a bore in a sidewall portion thereof, and wherein the intermediate piece includes a plurality of parallel bores having a hole pattern; coinciding the hole pattern with a further hole pattern on the guiding device; dimensioning the diameter of the parallel bores so that upstream portions of the channel inserts fit within the parallel bores of the intermediate piece; providing the intermediate piece with at least two supply lines for the liquid; and connecting each supply line with at least one other downstream opening of the intermediate piece.

Another embodiment of this invention pertains to an intermediate piece for carrying out the process of this invention, wherein the upstream attachment surface of the intermediate piece includes at least one upstream opening, wherein the downstream attachment surface of the intermediate piece includes at least one other downstream opening, wherein a flow-through type volume is located between the at least one upstream and downstream openings, and wherein the intermediate piece includes at least two supply lines for the liquid, with each supply line being connected with at least one volume.

In a further embodiment of the intermediate piece of this invention, the intermediate piece is divided into a plurality of volumes via a plurality of partition walls extending in a stream direction in one of partially and completely across the width of the intermediate piece. Preferably, the number of the supply lines located within the intermediate piece is at least as great as the number of the volumes.

In another embodiment of the intermediate piece of this invention, the intermediate piece includes a plurality of one of parallel arranged tubes and bores, with an interior of each of the tubes and bores forming the volume, with each of the tubes and bores having upstream and downstream ends, with the upstream and downstream ends extending up to a corresponding one of the upstream and downstream attachment surfaces, respectively, of the intermediate piece.

In a variation of the previous embodiment, the intermediate piece includes a guiding device with a plurality of channels, wherein the tubes and bores each have a downstream opening and are so arranged that each tube, at the downstream opening, is adapted to be connectable with one of the channels of the guiding device.

In a differing embodiment of the intermediate piece of this invention, the intermediate piece includes a current rectifier located between the upstream attachment surface and at least one of the volumes, with the current rectifier having a plurality of openings.

In yet a further embodiment of the intermediate piece of this invention, the intermediate piece includes a current rectifier located between the upstream attachment surface and at least one of the volumes, with the current rectifier having a plurality of openings, and wherein the tubes and bores at downstream ends thereof terminate into the openings of the current rectifier.

In carrying out this invention, a specially constructed element or part is subsequently interposed between the supply apparatus and the guiding device of the breast box. Such an element or part can be plate-shaped, but need not necessarily have an overall uniform thickness. As is known, all larger breast boxes are so constructed that, at the breast box, the supply apparatus, with the use of the usual erection tools, can be disassembled from the guiding device, provided that the breast boxes have these parts. The required intermediate part or portion, required for the operation in accordance with this invention, can thus be inserted or interposed between the two noted elements followed by the closing or reassembly of the breast box.

The shape of this intermediate portion provides a multiplicity of possibilities, in order to be able to fulfill the requirements that are needed for specific applications. Thus, for example, the suspension stream flowing through the intermediate portion can be divided into a multiplicity of sectional streams, or guided as a whole. The addition of the dilution water can also occur at many or at few locations, each depending upon which expenditure appears to be justified.

Even in these instances, wherein the guiding device, inserted downstream of the intermediate portion, includes a plurality of channels, generally no exact and thus expensive adaptation onto the pattern of these channels is necessary.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein:

FIG. 3*a* is a side view of one embodiment of the intermediate piece of this invention;

FIG. 3*b* is a top plan view of the embodiment of FIG. 3*a;*

FIG. 7 is a top plan view of another embodiment of the breast box of this invention;

FIG. 8*a* is a top plan view of a further embodiment of the breast box of this invention;

FIG. 8*b* is an enlarged detail of FIG. 8*a;*

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
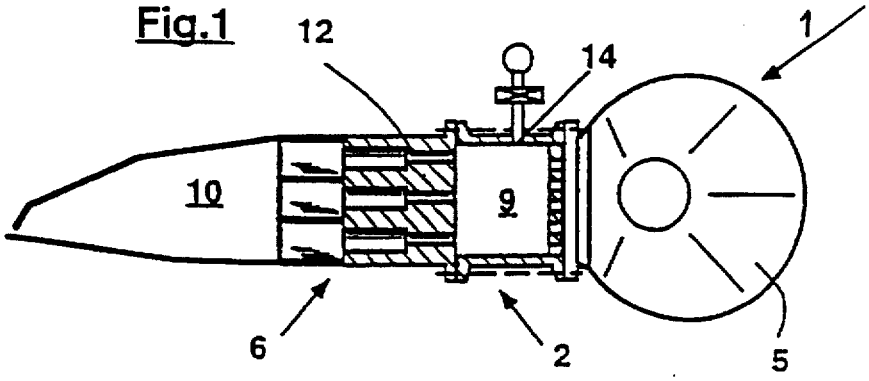
FIG. 1 is a portion sectional side view of the breast box of this invention.

FIG. 1 is a partial sectional view of a breast box 1, showing a supply apparatus 5 for the material suspension, having a downstream intermediate portion 2, which in turn has a downstream guiding or control device 6, having an adjacent nozzle chamber 10 that terminates in a wide gap or aperture. The schematically illustrated breast box is so operated that the material suspension, emanating from supply apparatus 5, enters into a volume or space 9 of intermediate portion 2 and flows therefrom into guiding device 6. Intermediate portion 2 includes one volume or space or several volumes or spaces 9, in which the suspension can flow through the intermediate piece or portion. During its way or flow therethrough, a liquid is added via supply line 14, whose density, as already described, differs from that of the material suspension. In this manner, via localized changes of the material density, influence can be exercised for example upon the local basis or area weight cross sectional profile or the local current or stream direction of the wide stream produced in the breast box.

Figure 2:
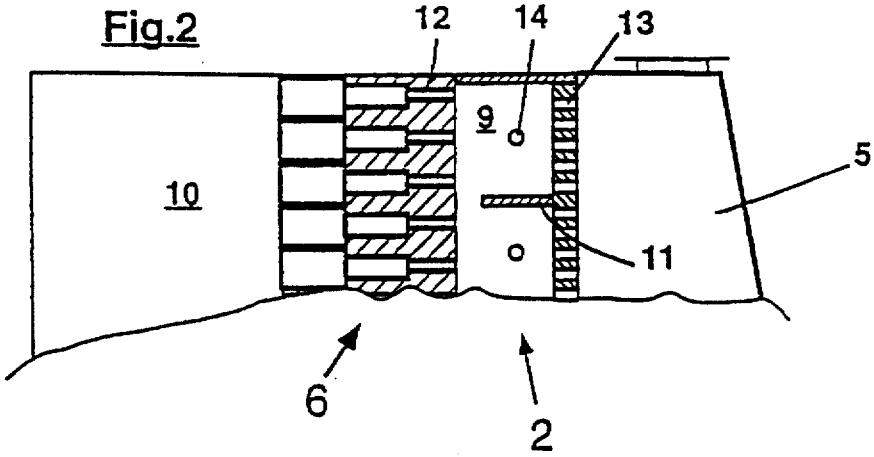
FIG. 2 is a top plan view of the breast box of FIG. 1.

The configuration of volumes or spaces 9 in intermediate portion 2 is largely determined via the cost to be expected for influencing of the cross profile or the fiber orientation to be obtained. It is feasible that intermediate portion 2 is comprised, essentially of a frame and thus includes but a single volume into which, at several locations, liquid can be added via supply lines 14. The flow-through chamber can also be subdivided, for example, via partition walls 11, as illustrated in FIG. 2. Walls 11 can extend, as shown herein, over a part of the intermediate portion or over the entire thickness or width of the intermediate portion, as shown in FIG. 3*b*.

The configuration of the intermediate portion or chamber, as per FIGS. 3*a* and 3*b*, includes, in the upstream direction, a current rectifier 16 with a plurality of openings 7'. Such an additional feature can be useful since, after the insertion of intermediate portion 2 into the breast box, the guiding device 6 can no longer effect a deviation of the stream from the distribution device in the longitudinal machine direction. This function can be taken up by the noted current rectifier 16.

Figure 4A:
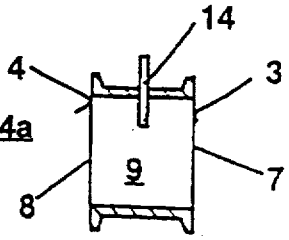
FIG. 4*a* is a side view of another embodiment of the intermediate piece of this invention.
Figure 5A:
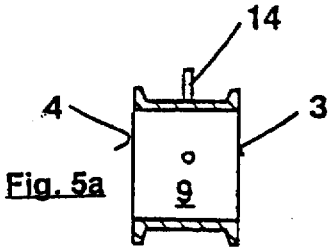
FIG. 5*a* is a side view of a further embodiment of the intermediate piece of this invention.
Figure 4B:
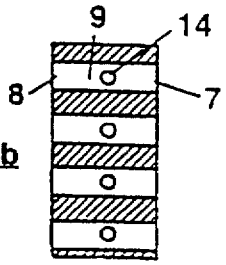
FIG. 4*b* is a top plan view of the embodiment of FIG. 4*a;*
Figure 5B:
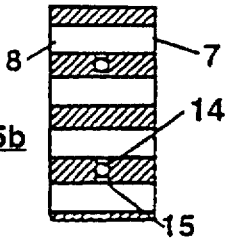
FIG. 5*b* is a top plan view of the embodiment of FIG. 5*a;*

Each pair of FIGS. 4a, 4b; 5a, 5b; and 6a, 6b, shown superposed, shows a side view on top and top plan view on the bottom, of different embodiments of intermediate portions. Therein, the embodiment of FIGS. 4a, 4b and 5a, 5b, have volumes 9 that extend over the entire height of the breast box that are supplied with liquid either from directly above, via supply lines 14, as in FIGS. 4a, 4b, or via the side, by means of channels 15, supplied by supply lines 14, as in FIGS. 5a, 5b.

Figure 6A:
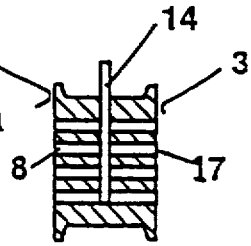
FIG. 6*a* is a side view of yet a different embodiment of the intermediate piece of this invention.
Figure 6B:
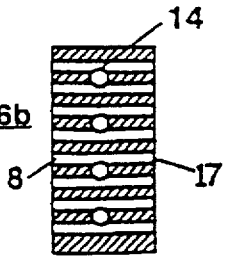
FIG. 6*b* is a top plan view of the embodiment of FIG. 6*a;*

FIG. 6 illustrates an intermediate portion having a plurality of pipes 17. Liquid is introduced via vertically arranged supply pipes that are in a flow through connection with pipes 17. Therein, for example, each vertical supply pipe can bisect two horizontally arranged pipes 17 and can supply liquid, at the interfaces, to the material suspension flowing therein.

In another embodiment, as in FIG. 7, of the breast box of this invention, intermediate portion 2 includes a plurality of pipes 17 for the material suspension. Pipes 17 are so arranged therein that they fit exactly into channels 12 of guiding device 6. The liquid is again introduced via supply lines 14 which here, via the intersection with pipes 17, permit the feeding thereof. It is deemed to be self evident that, each time, several supply lines 14 can be combined into a common supply line either within or outside of intermediate piece 2. In this manner, the control expenditure will be substantially less. The illustrated variation is very compact and effective but requires exact fitting onto the channels of the supply apparatus.

The shape or design of FIG. 8 utilizes the feature of some of the modern breast boxes wherein the guiding device 6 includes easily removable channel inserts 19 that are shown in two positions in FIG. 8b. Inserts 19 are readily replaced with longer channel inserts 19 which are, in addition, provided with bores 20 for liquid supply purposes. Intermediate portion 2 is then so constructed that the inserts which extend from guiding device 6 fit into corresponding bores 18.

It is also feasible not to replace the existing channel inserts 19 but merely to axially pull same outwardly a distance D, the latter corresponding about to the thickness or width of intermediate portion 2, and to provide same with bores 20 for fluid supply purposes and to secure same in this position or at the intermediate portion. For this reason, the intermediate portion includes bores 18 which have the same hole pattern as channels 12 in the guiding device. The diameters thereof correspond to about the outer diameter of channel inserts 19.

When the outer contour of channel inserts 19 is provided with ring-shaped steps or shoulders, ring-shaped hollow chambers can be formed therebetween in bores 18, which hollow chambers can be intersected by supply lines 14, that is, they can thus be provided with liquid. The liquid can then enter into the material suspension via side openings 20 in channel inserts 19. In the illustrated example, one supply line 14, each, can supply liquid to two adjacently arranged rows of superposed channel inserts.

There are further possibilities, not illustrated here, for supplying liquid to the suspension in the intermediate portion. Depending upon the constructional factors, particularly under the consideration of the required rigidity of the intermediate portion, such channels can be constructed. Often, due to the necessity for stiffening the intermediate portion, additional hollow chambers are formed which can serve as channels for feeding purposes.

Figure 9A:
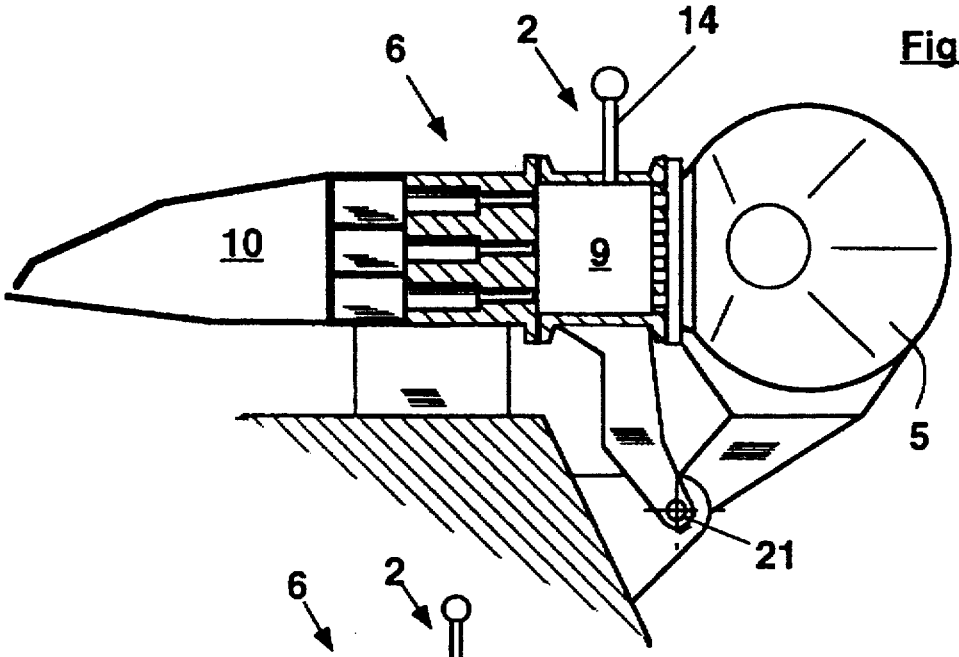
FIG. 9*a* is a partial side view of the breast box of this invention.
Figure 9B:
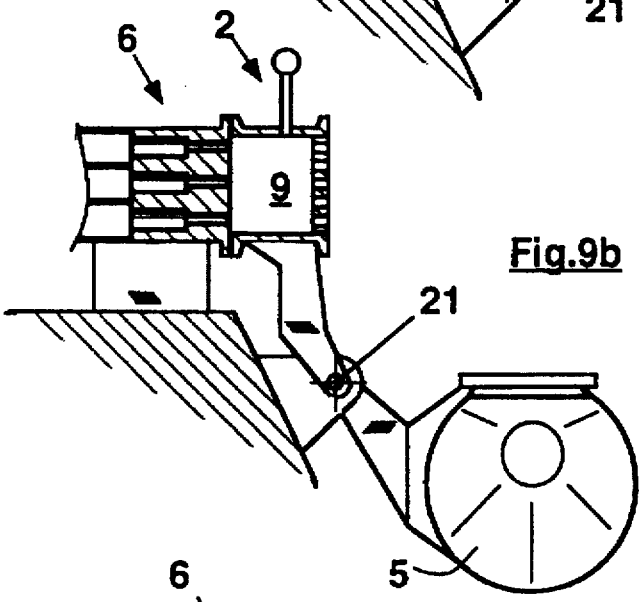
FIG. 9*b* is a variation of FIG. 9*a* showing the supply apparatus thereof, pivotally displaced.
Figure 9C:
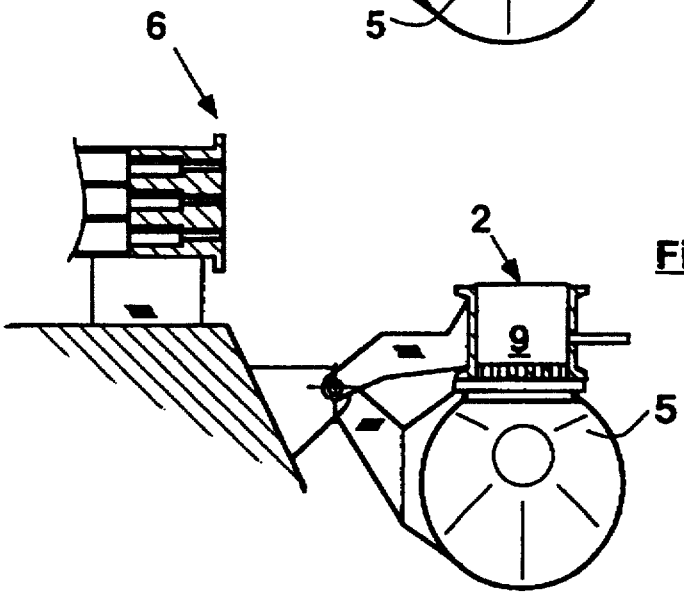
FIG. 9*c* is a further variation of FIG. 9*a* showing the supply apparatus and intermediate piece thereof, pivotally displaced.

FIGS. 9a to 9c show a further advantageous construction of a breast box of this invention. Therein, intermediate portion 2 as well as supply or distribution apparatus 5 are pivotally connected with the foundation about a common fulcrum or pivot point 21. Advantageously, a pivot point, already existing for the distribution apparatus can be utilized. During the operation of such a breast box it is occasionally necessary to separate the components from each other for service and cleaning purposes. It should be evident that such a procedure is always connected with an operational interruption of the papermaking machine. However, with the aid of the illustrated breast box such service work can be carried out very quickly since distribution device 5 can be pivoted alone, as in FIG. 9b, or together with intermediate part 2, as in FIG. 9c. Generally, for such pivoting, hydraulic actuators (not illustrated here) are utilized, which can also be fixedly installed. The device described herein can, without difficulties, also be carried over to those breast boxes that are initially equipped with an intermediate chamber for liquid-supplying purposes. In such an instance, the intermediate chamber would then correspond to intermediate portion 2 illustrated in FIGS. 9a to 9c.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A process for modifying an existing breast box for a papermaking or cartonmaking machine, the existing breast box including the following elements:

a) a supply apparatus for supplying a material suspension across the width of the machine;

b) a guiding device, for the material suspension, located downstream of the supply apparatus;

c) a nozzle chamber, having a wide aperture, from which aperture the material suspension exits as a stream from the breast box, located downstream of the guiding device; and the modified breast box including means for supplying a liquid, with the material density of the liquid differing from the material density of the suspension stream; the process comprising:

inserting a removable, prefabricated conversion part comprising an intermediate piece, having an upstream attachment surface and a downstream attachment surface, between the supply apparatus and the guiding device, with the material suspension flowing from the supply apparatus to the guiding device via the intermediate piece; and supplying the liquid, for the material suspension flowing through the intermediate piece during the operation of the breast box, via at least one supply line contained within the intermediate piece, with the material density of the liquid differing from the material density of the suspension stream.

2. The process of claim 1, wherein the guiding device of the breast box includes a plurality of channels, with the channels being formed with channel inserts, and the process further comprising:

extending the channel inserts from the guiding device, in the upstream direction, for an extent about equal to the thickness (D) of the intermediate piece and wherein each channel insert includes a bore in a sidewall portion thereof, and wherein the intermediate piece includes a plurality of parallel bores having a hole pattern;

coinciding the hole pattern with a further hole pattern on the guiding device;

dimensioning the diameter of the parallel bores so that upstream portions of the channel inserts fit within the parallel bores of the intermediate piece;

providing the intermediate piece with at least two supply lines for the liquid; and connecting each supply line with at least one downstream opening of the intermediate piece.

3. A process for modifying an exiting breast box for a papermaking or cartonmaking machine, the existing breast box including the following elements:

a) a supply apparatus for supplying a material suspension across the width of the machine;

b) a guiding device, for the material suspension, located downstream of the supply apparatus;

c) a nozzle chamber, having a wide aperture, from which aperture the material suspension exits as a stream from the breast box, located downstream of the guiding device; and the modified breast box including means for supplying a liquid, with the material density of the liquid differing from the material density of the suspension stream; the process comprising:

inserting an intermediate piece, having an upstream attachment surface and a downstream attachment surface, between the supply apparatus and the guiding device, with the material suspension flowing from the supply apparatus to the guiding device via the intermediate piece;

supplying the liquid, for the material suspension flowing through the intermediate piece during the operation of the breast box, via at least one supply line contained within the intermediate piece, with the material density of the liquid differing from the material density of the suspension stream, wherein the guiding device of the breast box includes a plurality of channels, with the channels being formed with the aid of channel inserts, and the process further comprising:

extending the channel inserts from the guiding device, in the upstream direction, for an extent about equal to the thickness (D) of the intermediate piece and wherein each channel insert includes a bore in a sidewall portion thereof, and wherein the intermediate piece includes a plurality of parallel bores having a hole pattern;

coinciding the hole pattern with a further hole pattern on the guiding device;

dimensioning the diameter of the parallel bores so that upstream portions of the channel inserts fit within the parallel bores of the intermediate piece;

providing the intermediate piece with at least two supply lines for the liquid; and connecting each supply line with at least one downstream opening of the intermediate piece.

* * * * *